US005897429A

United States Patent [19]

Durovchic

[11] Patent Number: 5,897,429

[45] Date of Patent: Apr. 27, 1999

[54] INJECTION MOLDING SEAT LAPPING DEVICE

[75] Inventor: John Durovchic, Vancouver, Wash.

[73] Assignee: Triquest Corporation, Vancouver, Wash.

[21] Appl. No.: 08/978,660

[22] Filed: Nov. 26, 1997

[51] Int. Cl.[6] ..... B24B 19/00

[52] U.S. Cl. ..... 451/430; 451/415; 451/431

[58] Field of Search ..... 451/259, 270, 451/344, 357, 359, 439, 441, 271, 431, 324, 400, 342, 291, 28, 49, 287, 290, 438, 429, 415, 430

[56] References Cited

U.S. PATENT DOCUMENTS

| | | | |
|---|---|---|---|
| 1,634,745 | 7/1927 | Fraser . | |
| 1,760,493 | 5/1930 | Hall | 451/431 |
| 1,941,918 | 1/1934 | Schwakopf | 51/241 |
| 2,010,759 | 8/1935 | Hall | 451/430 |
| 2,084,175 | 6/1937 | Zimmermann | 451/430 |
| 2,318,854 | 5/1943 | Hall | 451/431 |
| 2,338,763 | 1/1944 | Hall et al. | 451/431 |
| 2,466,359 | 4/1949 | Beverlin | 451/431 |
| 2,572,485 | 10/1951 | Hunter et al. | 451/431 |
| 2,649,669 | 8/1953 | Tobis | 451/431 |
| 2,756,552 | 7/1956 | Gordon | 451/271 |
| 2,984,054 | 5/1961 | Croft | 51/241 |
| 3,071,902 | 1/1963 | Curfman | 451/430 |
| 4,156,326 | 5/1979 | Frost, Jr. | 451/430 |
| 4,715,149 | 12/1987 | Kelsey | 451/430 |
| 4,923,343 | 5/1990 | Silk | 451/431 |
| 4,958,464 | 9/1990 | Menendez | 451/430 |
| 5,259,144 | 11/1993 | Yeh | 51/120 |

*Primary Examiner*—David A. Scherbel
*Assistant Examiner*—Denis Holt Banks
*Attorney, Agent, or Firm*—Stoel Rives LLP

[57] ABSTRACT

A lapping device for lapping an injection molding cylinder seat is provided having a housing that supports a gear system. A drive shaft having a lapping disk secured to one end thereof is mounted for rotation within the housing offset from the central axis thereof. The drive shaft and thus the lapping disk is driven about the central axis by the gearing system.

5 Claims, 4 Drawing Sheets

INJECTION MOLDING SEAT LAPPING DEVICE

TECHNICAL FIELD

This invention is directed to a lapping device for an injection molding machine, and more particularly to a portable lapping device for lapping an injection molding cylinder seat.

BACKGROUND OF THE INVENTION

In the manufacture of plastic injection molded products, plastic in a liquid form is transferred to a mold through an injection cylinder. The liquid plastic is typically advanced through the cylinder by an injection screw and is transferred to the mold through a nozzle tip connected to the end of the cylinder.

The end surface of the cylinder forms a sealing seat with the nozzle tip. In order to prevent the liquid plastic from leaking between the interface of the cylinder and the nozzle tip, the cylinder seat must be precisely flat. Over time the cylinder seat may become worn resulting in an unreliable seal. Once the cylinder seat becomes worn, it may be necessary to resurface it. In high production output operations, it is very expensive to shut down the system in order to resurface or recondition the cylinder seat. Typically, the injection cylinder must be disassembled and then transferred to another facility capable of resurfacing the injection cylinder seat. Additional costs usually arise by having to transport the injection cylinder to and from the other facility.

Lapping devices are known in the art for finish-grinding a surface. For example, U.S. Pat. No. 5,259,144 discloses a lapping device for a safety relief valve. This device comprises a plurality of grinding disks driven by a planetary gear system. Each disk rotates about its own axis and all of the disks are driven about a common central axis to lap the safety relief valve. The grinding face of each disk is in constant engagement with entire width of the surface of the valve seat during the grinding process. This is detrimental because it causes the edges of the valve seat to become rounded which creates a less effective seal.

U.S. Pat. Nos. 1,941,918; 2,984,054; 2,649,669; and 1,634,745 all disclose various lapping devices and grinding machines. However, all of these devices are complicated in operation and are expensive to manufacture. Additionally, these devices are limited in their application to only one type and size of valve or other workpiece and are not capable of precision grinding a seal face of various sizes of injection molding cylinders.

SUMMARY OF THE INVENTION

It is an object of the present invention to provide a lapping machine adapted for use with various sized injection molded cylinders.

It is another object of the present invention to provide a lapping device that prevents high and low spots on the cylinder seat.

Yet another object of the invention is to provide a lapping device that provides a precisely flat surface.

The lapping device of the present invention is secured to an injection molded cylinder by an adjustable bracket system. A lapping disk is held by a shaft that extends through a housing securely fastened through the bracket system to the injection molding cylinder. The housing supports a gear system that is driven by a hand-held power device. The hand-held power device rotates a central off-set cam or eccentric that drives the gear set to rotate the lapping disk about a central axis while driving the lapping disk eccentrically about a central axis of the housing. This motion prevents the lapping disk from full-width engagement with the cylinder seat during resurfacing.

In another preferred embodiment, a lapping disk is driven by a hand-powered device through a gear housing in which the gear housing rotates along with the lapping disk about a central drive shaft.

Additional objects and advantages of this invention will be apparent from the following detailed description of preferred embodiments thereof which proceeds with reference to the accompanying drawings.

DETAILED DESCRIPTION OF PREFERRED EMBODIMENT

Figure 1:
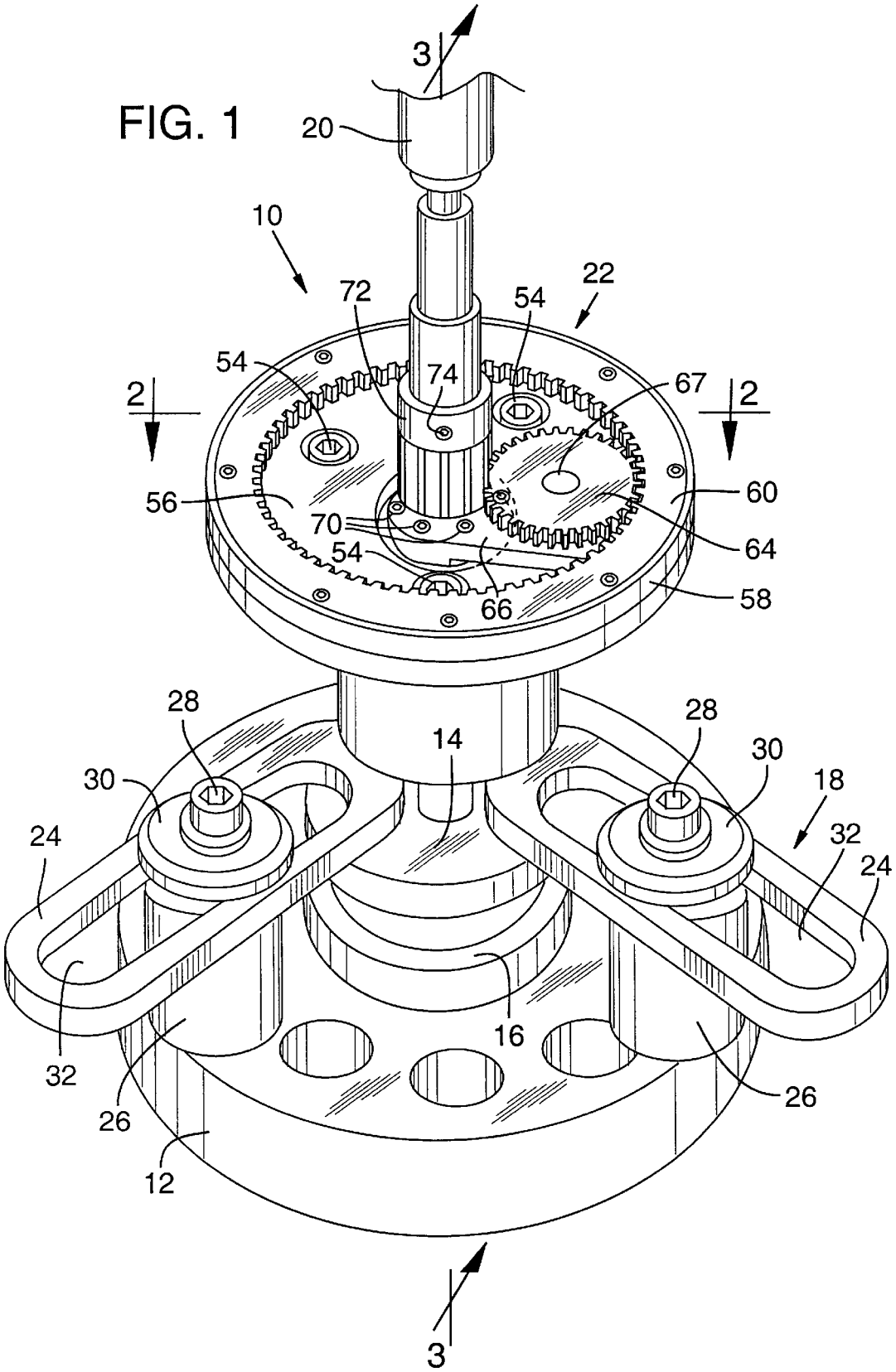
FIG. 1 is a perspective view of an injection molding cylinder seat lapping device of the present invention.
Figure 2:
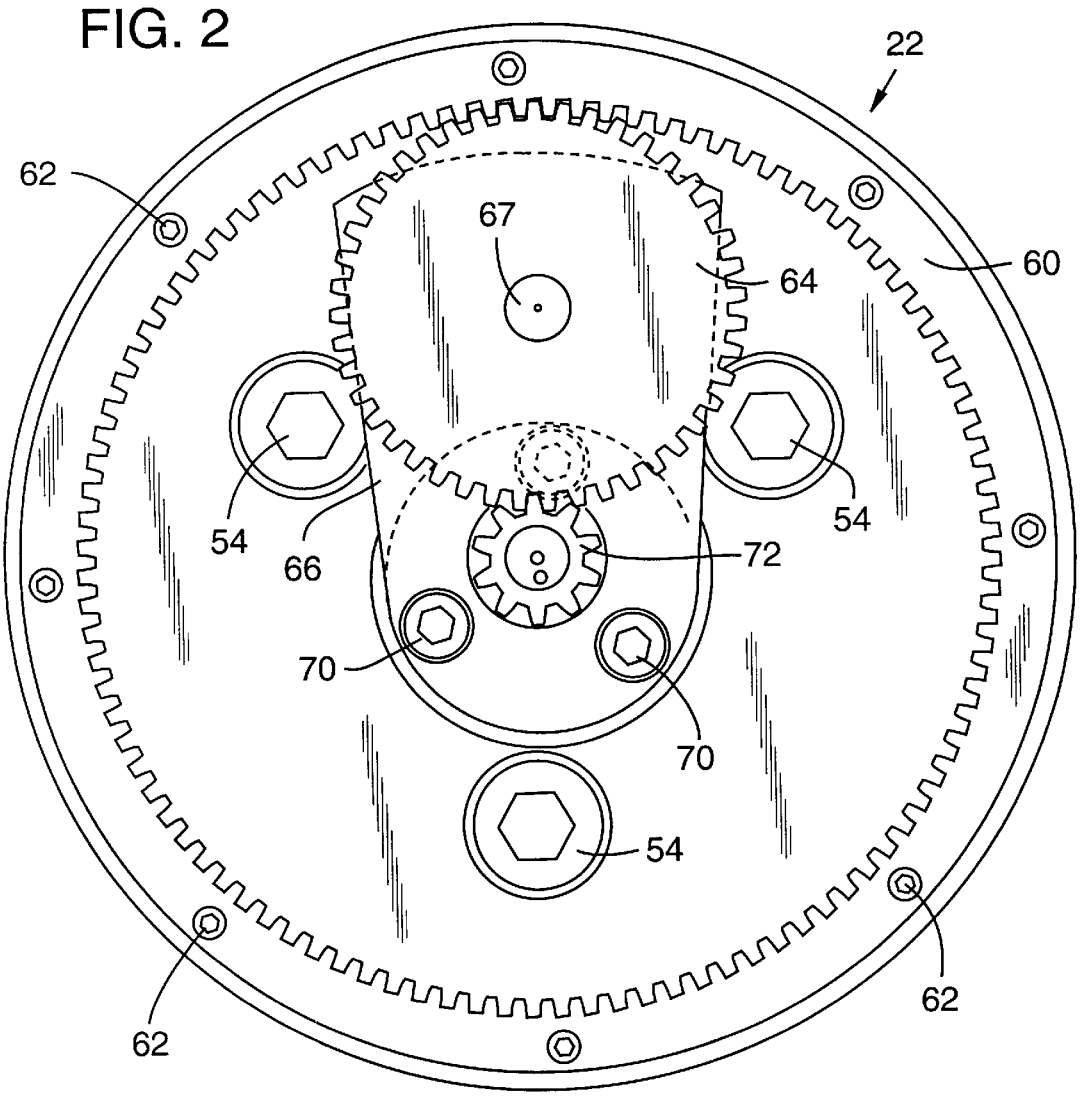
FIG. 2 is a view taken along line 2—2 in FIG. 1.

The lapping device 10 of the present invention is shown in FIG. 1 being attached to an injection molding cylinder 12. The lapping device 10 drives a lapping disk 14 to lap an end surface or seat 16 of the cylinder. The lapping device 10 is attached to the cylinder 12 by a bracket system 18 and is driven by a hand-held power device 20 through a gear system 22.

Figure 3:
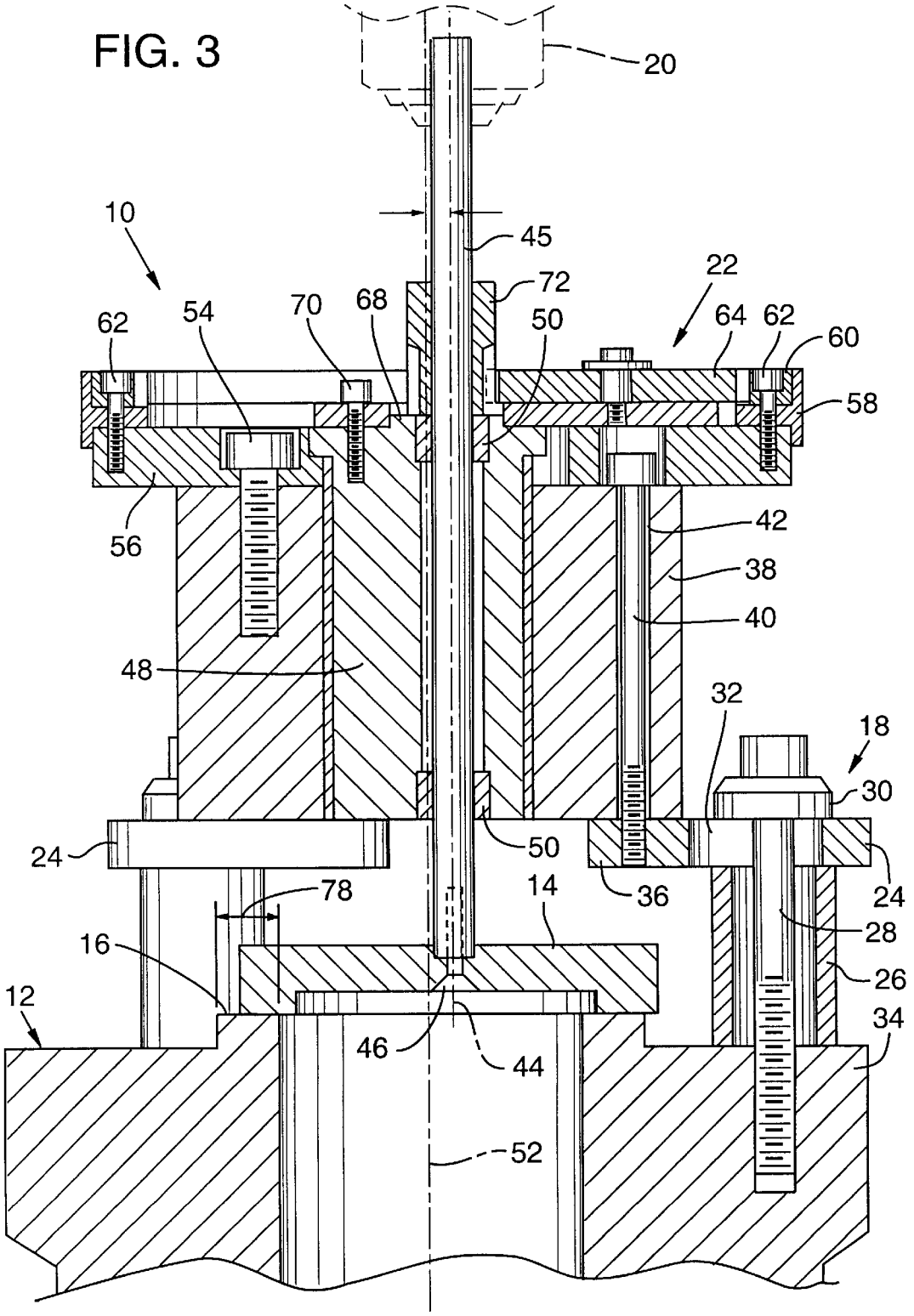
FIG. 3 is a cross sectional view taken along 3—3 of FIG. 1.

The bracket system 18 includes at least three straps 24. The straps 24 are supported on the cylinder 12 in a spaced relation by an equal number of spacers 26. Each strap 24 is secured to the cylinder 12 by a fastener, such as a bolt 28, that extends through a washer 30, an elongated opening 32 in the strap 34, and through the spacer 26. The bolt 28 is screwed into a threaded opening in the cylinder flange 34. The elongated openings in the straps allow the lapping 10 device to be attached to cylinders of different diameters. As seen most clearly in FIG. 3, the inner ends 36 of the straps are attached to a base 38 that supports the gear system 22 by a threaded fastener 40 extending through an opening 42 in the base.

The lapping disk 14 is driven by the hand-held device to rotate about the axis 44. The hand-held device 20 is operatively connected to a drive shaft 45 which is connected to the lapping disk 14 by a screw fastener 46. The drive shaft 45 is mounted for rotation through an eccentric 48 located in the base 40. The drive shaft 45 is supported within the eccentric 48 by bearings 50.

The eccentric 48 is mounted for rotation about its central axis 52 within the base 38 which is offset from the axis 44. The eccentric 48 is rotated by the gear system 22 that is securely mounted to the base 38 by a plurality of fasteners 54 that extend through a locator plate 56. The locator plate supports a locator ring 58 that extends around the outer periphery of the locator plate 56 and that supports a ring gear 60. Both the ring gear 60 and locator plate 56 are connected to the locator plate 56 by fasteners 62.

The ring gear 60 operatively engages a gear 64 rotatably mounted on a gear holder 66 by a screw 67. The gear holder 66 is mounted on the eccentric 48 through a raised hub 68 that fits within a hole in the gear holder 66 and is secured to the eccentric 48 by a plurality of fasteners 70. The gear 64 is also in engagement with a pinion gear 72 non-rotatably secured to the drive shaft 45 by a screw 74 (FIG. 1).

Thus, it can be seen that in operation the powered drive device 20 rotates the drive shaft 45 and, thus, the lapping disk 14 about the axis 44. The pinion gear 72 rotates the gear 64 which, through engagement with the ring gear 60, rotates the eccentric 48 through the gear holder 66. The eccentric 48 rotates the drive shaft 45 and lapping disk 14 about the central axis 52 causing the lapping disk 14 to wobble or move back and forth across the seat 16 as the lapping disk 14 rotates.

Preferably, the width 76 of the grinding face of lapping disk 14 is between about one-eighth and one-sixteenth of an inch less than the width 78 of the seat 16. Therefore, the full width 78 of the seat is not constantly engaged by the lapping disk 14 during resurfacing. This prevents the edges of the seat 16 from becoming rounded which would form a less reliable seal.

Figure 4:
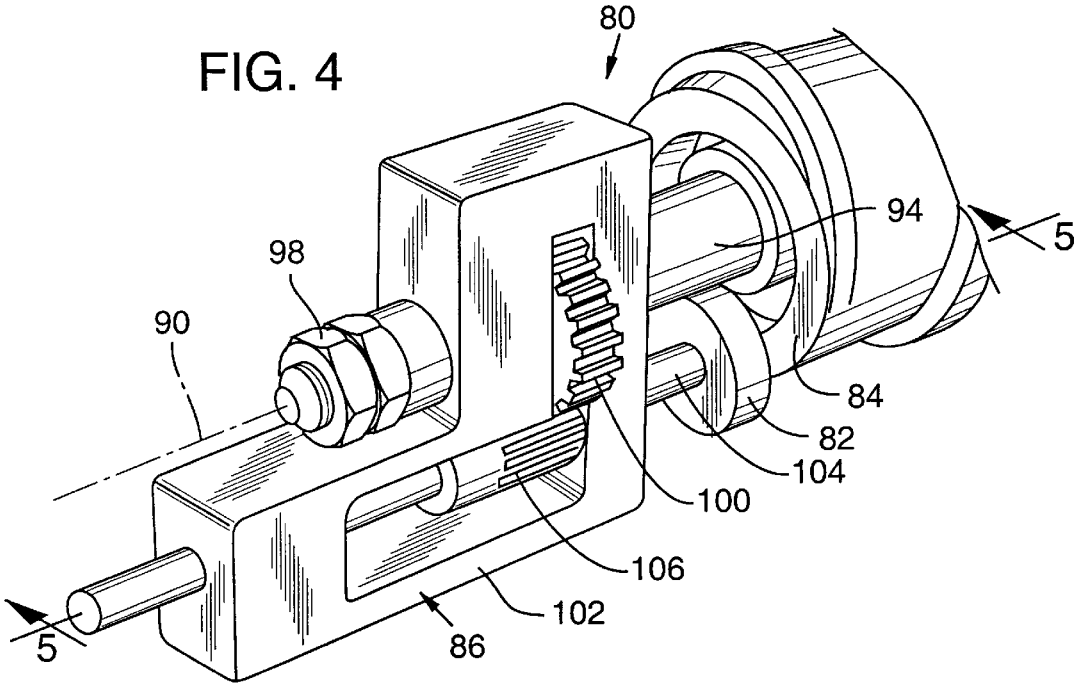
FIG. 4 is an isometric view of another embodiment of the invention.
Figure 5:
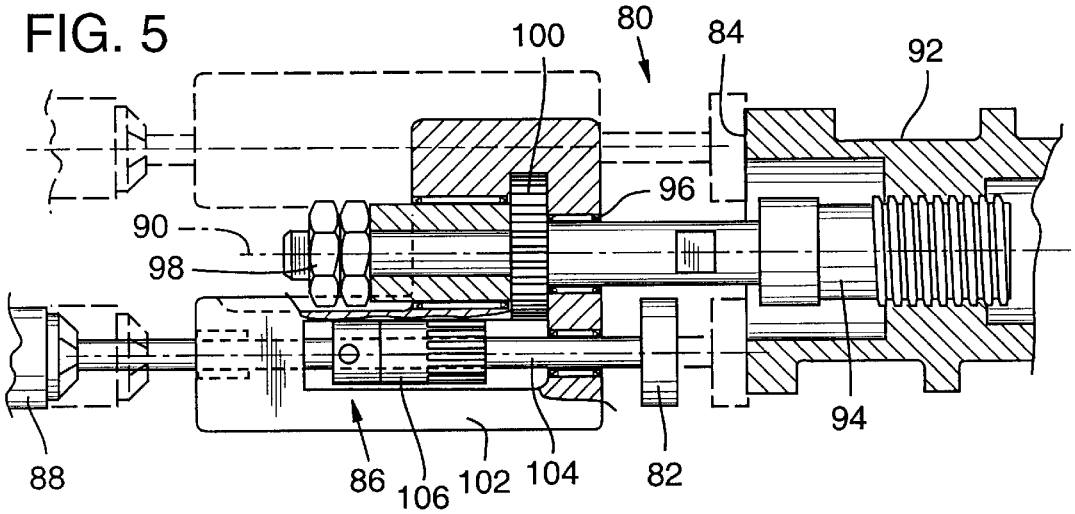
FIG. 5 is a cross sectional view taken through lines 5—5 in FIG. 4.

Another embodiment 80 is shown in FIGS. 4 and 5. In this embodiment, a lapping disk 82 is driven to resurface a seat 84 through a gear housing 86 by a hand-held device 88 (shown in phantom in FIG. 5) so that the gear housing 86 rotates about the central axis 90 of the hand-held device 88. The gear housing 86 is secured to the cylinder 92 by a screw arbor 94 that extends through an opening 96 in the gear housing 86 and has screw threads on one end for a threaded engagement with the cylinder 92. The screw arbor 94 is secured to the gear housing 86 through nuts 98 at the opposite end thereof. A non-rotatable drive gear 100 is secured to the screw arbor 94. The gear housing 86 includes an offset portion 102 through which a drive shaft 104 extends. The lapping disk 82 is secured to the drive shaft 104 at one end thereof by a fastener such as a screw (not shown). A pinion gear 106 is secured to the drive shaft 104 in a central portion of the gear housing 86 for engagement with the drive gear 100. The opposite end of the drive shaft 104 is engaged with the hand-held drive device 88 for rotation. The drive shaft 104 can be advanced and retracted within the gear housing 86 to engage and disengage the pinion gear 106 and drive gear 100 as seen in phantom in FIG. 5. In the advanced position, the pinion gear 106 and drive gear 100 are engaged and the lapping disk 82 engages the cylinder seat 84.

In operation, as the hand-held drive device 88 rotates the drive shaft 104, the gear housing 86 and thus the lapping disk 82 rotate about the central axis 90 through engagement of the pinion gear 106 and the stationary drive gear 100. Needle bearings 108 are located within the gear housing 86 to allow for rotation.

It will be obvious to those having skill in the art that many changes may be made to the details of the above-described embodiment of this invention without departing from the underlying principles thereof. The scope of the present invention should, therefore, be determined only by the following claims.

I claim:

1. A lapping device for lapping an injection molding cylinder comprising:

a housing;

a connection system for connecting a housing to an injection molding cylinder, the connection system having an adjustable bracket for connecting the lapping device to the injection molding cylinder, the bracket comprising a plurality of elongated straps, each of which has an end connected to the housing and an elongated central opening through which each strap is connected to the housing by a fastener, and a spacer associated with strap for supporting and spacing each strap from the injection molding cylinder;

a lapping disk;

a drive motor for driving a drive shaft connected to the lapping disk, the drive shaft being offset from the central axis of the injection molding cylinder; and a gear system connected to the housing for causing the drive shaft to rotate about the central axis of the injection molding cylinder.

2. The lapping device of claim 1 further comprising an eccentric mounted full rotation within the housing, wherein the drive shaft is mounted for rotation within the eccentric such that the gear system causes the drive shaft to rotate about the central axis of the injection molding cylinder.

3. A lapping device for lapping an injection molding cylinder seat comprising:

a housing;

a connection system for connecting the housing to an injection molding cylinder having a central axis, the connection system comprising an screw arbor mounted within the housing and having a drive gear nonrotatably mounted thereon;

a lapping disk;

a drive motor for driving a drive shaft connected to the lapping disk, the drive shaft being offset from the central axis of the injection molding cylinder; and a gear system connected to the housing for causing the drive shaft to rotate about the central axis of the injection molding cylinder.

4. The lapping device of claim 3 wherein the housing includes an offset portion for rotatably mounting the drive shaft.

5. The lapping device of claim 3 further comprising a pinion gear secured to the drive shaft adapted to be engaged and disengaged with the drive gear, such that when the pinion gear engages the drive gear, the housing and thus the drive shaft rotate around the central axis of the injection molding cylinder.

* * * * *